US009500044B2

(12) United States Patent
Twardowski

(10) Patent No.: US 9,500,044 B2
(45) Date of Patent: Nov. 22, 2016

(54) TUBULAR COUPLING DEVICE

(75) Inventor: Eric M. Twardowski, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 724 days.

(21) Appl. No.: 13/480,652

(22) Filed: May 25, 2012

(65) Prior Publication Data

US 2012/0298376 A1 Nov. 29, 2012

Related U.S. Application Data

(60) Provisional application No. 61/490,033, filed on May 25, 2011.

(51) Int. Cl.
*E21B 17/046* (2006.01)
*E21B 31/20* (2006.01)
*E21B 17/02* (2006.01)

(52) U.S. Cl.
CPC ..... *E21B 17/046* (2013.01); *E21B 17/02* (2013.01); *E21B 31/20* (2013.01)

(58) Field of Classification Search
CPC ..... E21B 17/02; E21B 17/046; E21B 17/06; E21B 17/08
USPC ..... 166/242.7; 285/26, 29, 317, 913, 922
See application file for complete search history.

(56) References Cited

U.S. PATENT DOCUMENTS 2,976,931 A * 3/1961 Daffin ..... 166/125
3,893,717 A * 7/1975 Nelson ..... 285/3
3,948,547 A * 4/1976 Gache ..... 285/317
4,729,433 A 3/1988 Jacob
4,830,408 A * 5/1989 Reimert ..... E21B 17/046 285/27
4,953,640 A * 9/1990 Kurt ..... E21B 17/046 175/320
4,995,458 A * 2/1991 Garbett ..... 166/85.3
6,450,541 B1 9/2002 Bakke
6,637,781 B1 10/2003 Seymour, II
7,059,881 B2 6/2006 Song et al.
7,360,594 B2 4/2008 Giroux et al.
8,839,880 B2 * 9/2014 Trevino et al. ..... 175/61
2006/0278402 A1 * 12/2006 Mullins ..... 166/380
2008/0041587 A1 2/2008 Bell et al.
2009/0301711 A1 * 12/2009 Jagert et al. ..... 166/242.6
2010/0126776 A1 * 5/2010 Trevino ..... E21B 7/20 175/61

OTHER PUBLICATIONS

PCT Search Report and Written Opinion for International Application No. PCT/US2012/039711 dated May 3, 2013.
Canadian Office Action dated Nov. 28, 2014, Canadian Patent Application No. 2,837,085.

* cited by examiner

*Primary Examiner* — David Andrews
*Assistant Examiner* — Tara Schimpf
(74) *Attorney, Agent, or Firm* — Patterson & Sheridan, LLP

(57) ABSTRACT

A coupling device includes an upper adapter and a lower adapter. The lower adapter may be pre-installed on a downhole tool and positioned in a wellbore. The upper adapter may be attached to a conveyance and lowered into the wellbore for connection with the lower adapter. The upper adapter may be coupled to the lower adapter by sliding over the lower adapter and applying weight to actuate a locking mechanism. After coupling, axial and torque load may be transmitted from the conveyance to the downhole tool.

23 Claims, 19 Drawing Sheets

TUBULAR COUPLING DEVICE

CROSS-REFERENCE TO RELATED APPLICATIONS

This application claims benefit of U.S. Provisional Patent Application No. 61/490,033, filed May 25, 2011, which application is incorporated herein by reference in its entirety.

BACKGROUND OF THE INVENTION

1. Field of the Invention

Embodiments of the invention generally relate to a tubular coupling device. Particularly, embodiments of the invention relate to a tubular coupling device for transmitting axial and torque loads.

2. Description of the Related Art

In the drilling, completion, and operation of a hydrocarbon well, various wellbore components are inserted and removed from a wellbore on a lower end of a conveyance such as a tubular string. Exemplary wellbore components include packers (to seal off production zones), motors, pumps, sensors, sliding sleeves (to control flow of fluid in and out of production tubing), hydraulically set liners (for lining during cementing of casing), whipstocks (to divert drill bit while drilling), valves, cement shoe assemblies, another tubular string, and drill bits.

As wellbore components are delivered and removed from a wellbore, the components or the tubular string they are attached to may become stuck in the wellbore. To permit a conveyance to be separated from a stuck component, disconnect devices are placed at intervals in the drill string. A disconnect device is a component that can be selectively separated into two portions. For example, a disconnect device disposed in a string of tubulars can permit the string to be separated and the lower part left in the wellbore for accessibility by fishing tools. Likewise, a disconnect device disposed between the end of a tubular string and a wellbore component, like a drill bit, permits the selective removal of the string of tubulars if the bit should become stuck.

Some disconnect devices also allow for connection to a downhole component. One known disconnect device relies on rotational make up of the disconnect device to the downhole component using torque applied from the surface. If the distance to the downhole component is large, torsional deflection of the drill string may cause an inadequate amount of make up torque to be applied to the connection. The incomplete make up may be problematic in a drilling operation because reactive torque from the drilling process may cause the connection to back off.

There is a need therefore, for a coupling device for connecting a string to a downhole component without using torque. There is also a need for coupling device capable for transmitting axial and torque loads to the downhole component after connection.

SUMMARY OF THE INVENTION

In one embodiment, a coupling device includes an upper adapter and a lower adapter. The lower adapter may be pre-installed on a downhole tool and positioned in a wellbore. The upper adapter may be attached to a conveyance and lowered into the wellbore for connection with the lower adapter. The upper adapter may be coupled to the lower adapter by sliding over the lower adapter and applying weight to actuate a locking mechanism. After coupling, axial and torque loads may be transmitted from the conveyance to the downhole tool.

In another embodiment, a coupling device for coupling a conveying member to a downhole tool includes a first adapter connected to the conveying member; a second adapter connected to the downhole tool; and a locking mechanism for connecting the first adapter to the second adapter, wherein the locking mechanism is actuated by axial movement of the first adapter relative to the second adapter, and wherein the coupling device is configured to transmit axial and torque loads from the conveying member to the downhole tool after the first adapter connects to the second adapter. In yet another embodiment, the locking mechanism includes a locking member engageable to a locking profile.

In one or more of the embodiments described herein, the locking mechanism includes a locking member engageable to a locking profile.

In one or more of the embodiments described herein, the locking member comprises a retractable dog and the locking profile comprises a groove.

In one or more of the embodiments described herein, the locking member comprises a collet and the locking profile comprises a shoulder.

In one or more of the embodiments described herein, the locking mechanism further comprises a locking sub disposed in the first adapter for housing the locking member.

In one or more of the embodiments described herein, the locking member is radially movable.

In one or more of the embodiments described herein, the coupling device includes a biasing member for moving the locking member.

In one or more of the embodiments described herein, the coupling device includes a guiding member for guiding movement of the locking member.

In one or more of the embodiments described herein, the coupling device includes a retention member for preventing retraction of the locking member.

In one or more of the embodiments described herein, the coupling device includes a retainer for limiting movement of the locking member.

In one or more of the embodiments described herein, the locking member is on the first adapter and the locking profile is on the second adapter.

In one or more of the embodiments described herein, the torque load is transmitted using a spline connection between the first adapter and the second adapter.

In yet another embodiment, a method of connecting a first tool to a second tool in a wellbore includes attaching a first adapter to the first tool, wherein the first adapter includes a locking member; attaching a second adapter to the second tool, wherein the second adapter includes a locking profile for receiving the locking member; positioning the second adapter and the second tool in the wellbore; lowering the first adapter and the first tool; and engaging the locking member to the locking profile by axially moving the first adapter relative to the second adapter, wherein axial and torque loads are transmittable from the first tool to the second tool. Axially moving the first adapter may comprise sliding the first adapter over the second adapter.

In one or more of the embodiments described herein, axially moving the first adapter comprises sliding the first adapter over the second adapter.

In one or more of the embodiments described herein, the method includes preventing release of the first adapter from the second adapter.

In one or more of the embodiments described herein, preventing release comprises providing mating surfaces on the locking member and the locking profile; and engaging the mating surfaces of the locking member to the mating surfaces of the locking profile when the first adapter and the second adapter are placed in tension.

In one or more of the embodiments described herein, preventing release comprises providing a retention pin for preventing retraction of the locking member when the first adapter and the second adapter are placed in compression.

In yet another embodiment, a method of manipulating a downhole tool in a wellbore using a conveying member includes attaching a first adapter to the conveying member, wherein the first adapter includes a locking member; attaching a second adapter to the downhole tool, wherein the second adapter includes a locking profile for receiving the locking member; lowering the first adapter and the conveying member; engaging the locking member to the locking profile by axially moving the first adapter relative to the second adapter; rotating the downhole tool by transmitting torque from the conveying member; and axially moving the downhole tool by transmitting axial loads from the conveying member. In another embodiment, the method further includes selectively releasing the downhole tool from another downhole tool.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In one embodiment, a coupling device includes an upper adapter and a lower adapter. The lower adapter may be pre-installed on a downhole tool and positioned in a wellbore. The upper adapter may be attached to a conveyance and lowered into the wellbore for connection with the lower adapter. The upper adapter may be coupled to the lower adapter by sliding over the lower adapter and applying weight to actuate a locking mechanism. After coupling, axial and torque loads may be transmitted from the conveyance to the downhole tool.

Figure 1A:
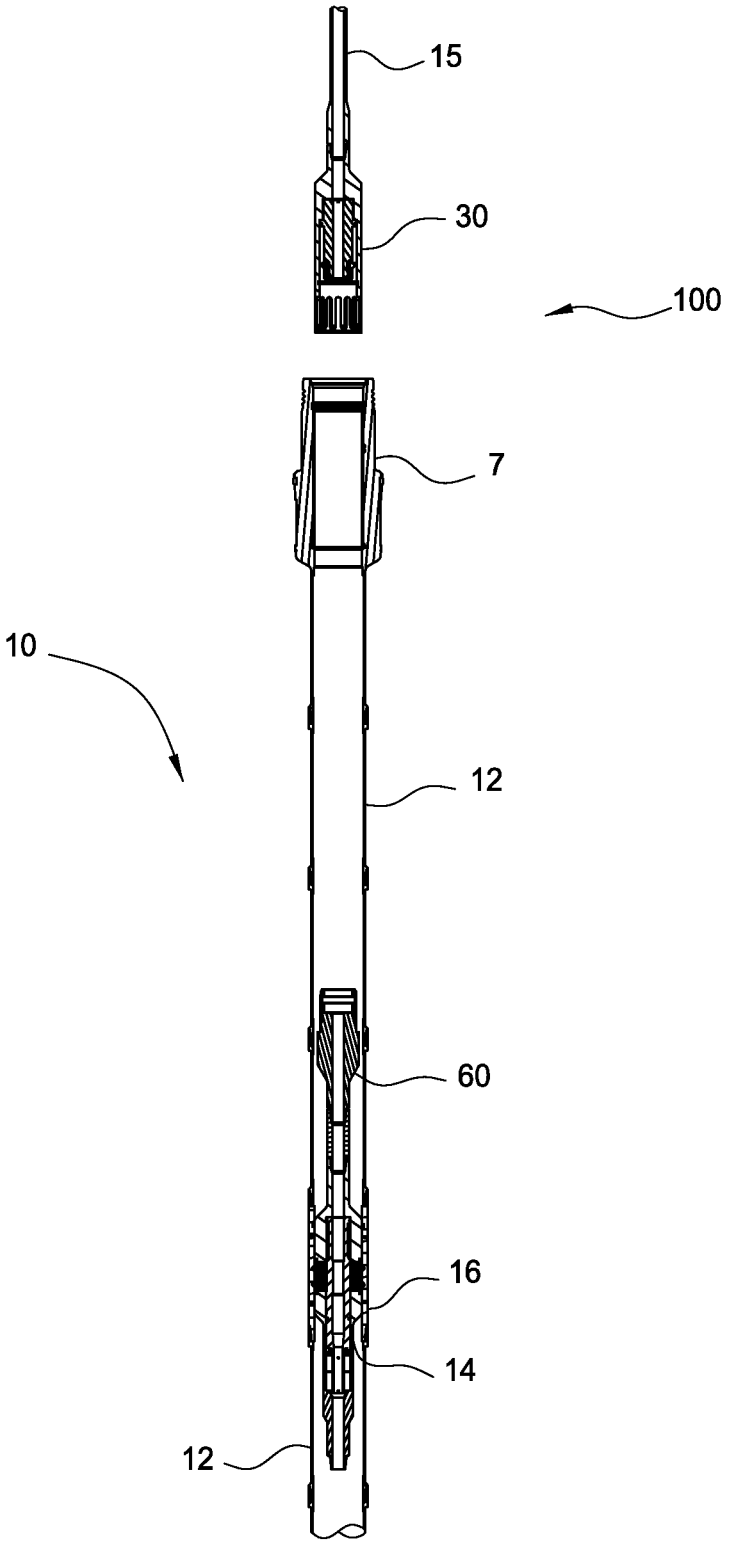
FIG. 1A is a schematic view of an embodiment of a coupling device used with a drilling system.

FIG. 1A is a schematic view of an embodiment of a coupling device 100 used with a drilling system 10. The drilling system 10 includes a casing string 12, which may have a drill bit at a lower end thereof. A running tool 14 is attached to an interior of the casing string 12 for coupling to a conveyance such as a drillstring 15. The running tool 14 may be attached to the casing string 12 using a casing adapter 16. A suitable running tool is disclosed in U.S. Patent Publication No. 2010/0126776, which publication is incorporated herein by reference in its entirety. In one example, the running tool 14 is adapted to releasably engage the casing adapter 16 connected to the casing string 12. The running tool 14 includes a running tool body having one or more engagement members such dogs, clutch, or tabs. For example, the running tool 14 includes axial dogs spaced circumferentially in the running tool body for transferring axial forces to the casing adapter 16. The axial dogs may include one or more horizontally aligned teeth that are adapted to engage an axial profile such as a circular groove in the casing adapter 16. The axial dogs may be biased inwardly using a biasing member such as a spring. The running tool 14 may optionally include one or more torque dogs spaced circumferentially in the running tool body for transferring torque to the casing adapter 16. The torque dogs may include one or more axially aligned teeth that are adapted to engage corresponding torque profiles in the casing adapter 16. The torque dogs may be biased outwardly using a biasing member such as a spring. One or more seals may be positioned between the casing adapter 16 and the running tool 14 to seal off the interface. A high pressure wellhead housing 7 may optionally be disposed at an upper end of the casing string 12.

Figure 2:
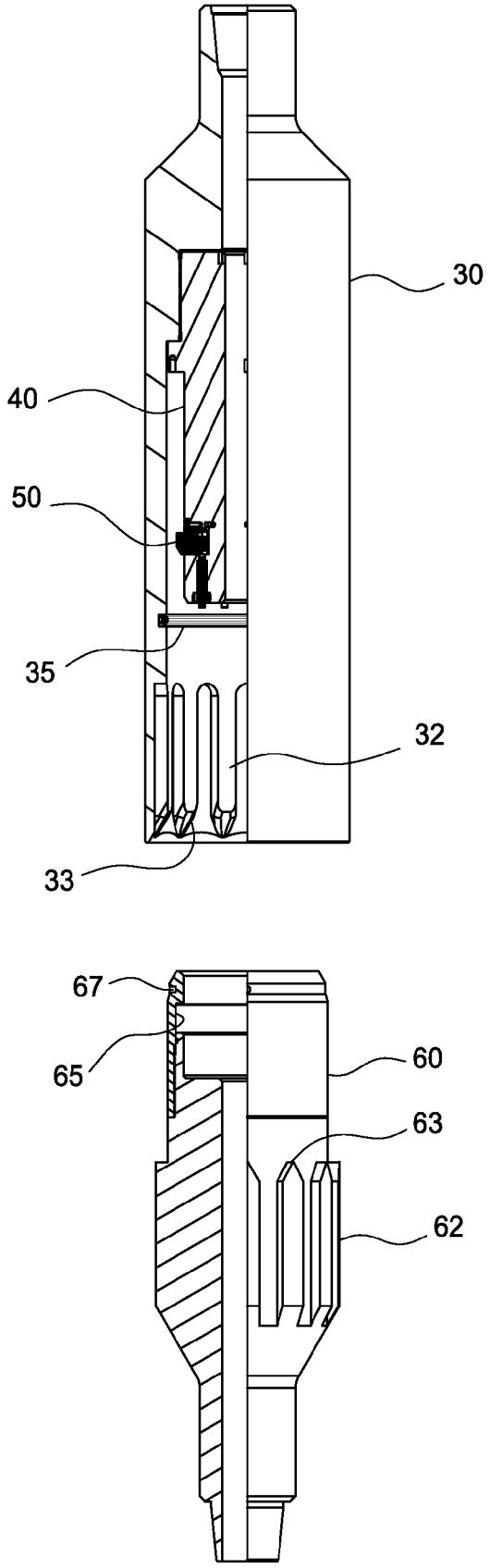
FIG. 2 is a schematic view of an upper adapter and a lower adapter of the coupling device of FIG. 1A.

In one embodiment, the coupling device 100 includes an upper adapter 30 selectively attachable to a lower adapter 60. As shown in FIG. 2, the upper adapter 30 has a first end configured for connection to the drillstring 15 (and may be referred to as a "conveyance adapter") and a second end for connection with the lower adapter 60. The lower adapter 60 has a first end configured for connection to a wellbore component such as the running tool (and may be referred to as a "component adapter") and a second end for connection with the conveyance adapter 30. The component adapter 60 may be attached to the running tool 14 and preinstalled in the casing string 12. The conveyance adapter 30 may be lowered into the casing string 12 and connected with the component adapter 60, thereby coupling the drillstring 15 to the casing string 12. After coupling, axial and torque loads may be transmitted from the drillstring 15 to the casing string 12 for the drilling operation. In one embodiment, the conveyance adapter 30 connection to the component adapter 60 is non-releasable downhole.

Figure 3:
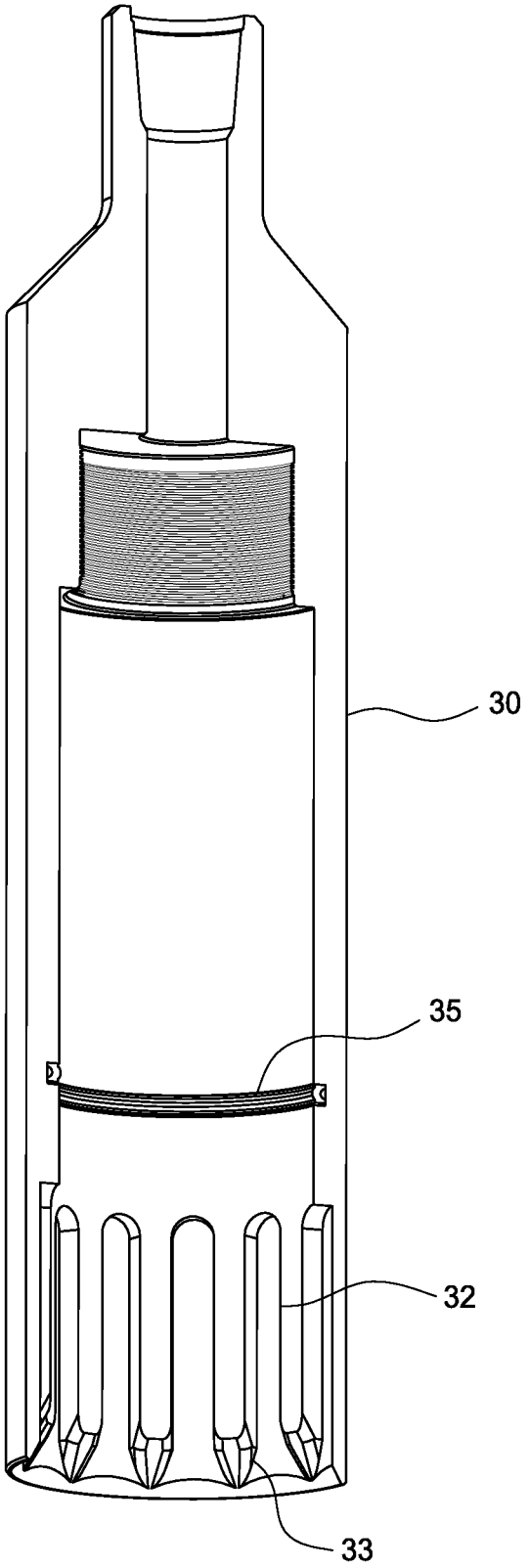
FIG. 3 is a cross-sectional view of the upper adapter of the coupling device of FIG. 1A.
Figure 4:
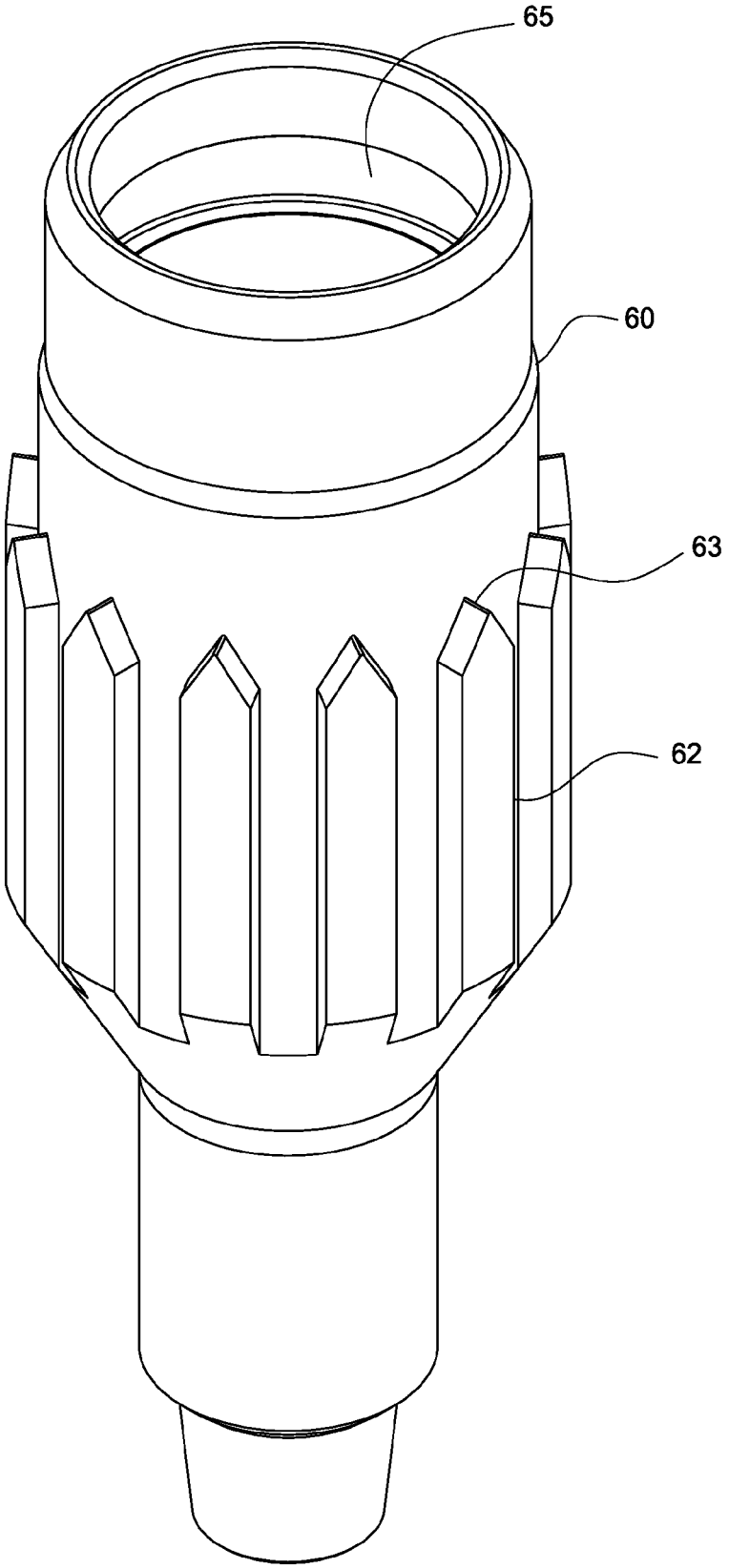
FIG. 4 is a perspective view of the lower adapter of the coupling device of FIG. 1A.

The component adapter 60 and conveyance adapter 30 are both tubular shaped and include an axial bore therethrough. FIGS. 3 and 4 are enlarged views of the component adapter 60 and the conveyance adapter 30. The component adapter 60 has an outer diameter that is smaller than the inner diameter of the conveyance adapter 30, so that the component adapter 60 can be at least partially inserted into the conveyance adapter 30 for coupling. The outer diameter of the component adapter 60 includes splines 62 for mating with splines 32 on the inner diameter of the conveyance adapter 30 to allow transfer of torque therebetween. In one embodiment, the ends 33, 63 of the splines 32, 62 facing each other may be tapered to facilitate circumferential alignment of the adapters 30, 60. Also, the spline end 33 of the conveyance adapter 30 may be tapered outwardly to facilitate axial alignment of the adapters 30, 60. A seal 35 may be disposed on the inner surface of the conveyance adapter 30 for sealing engagement with the component adapter 60 when the adapters 30, 60 are connected. Exemplary seals include o-rings, fs-seals, s-seals, and p-seals.

Figure 5:
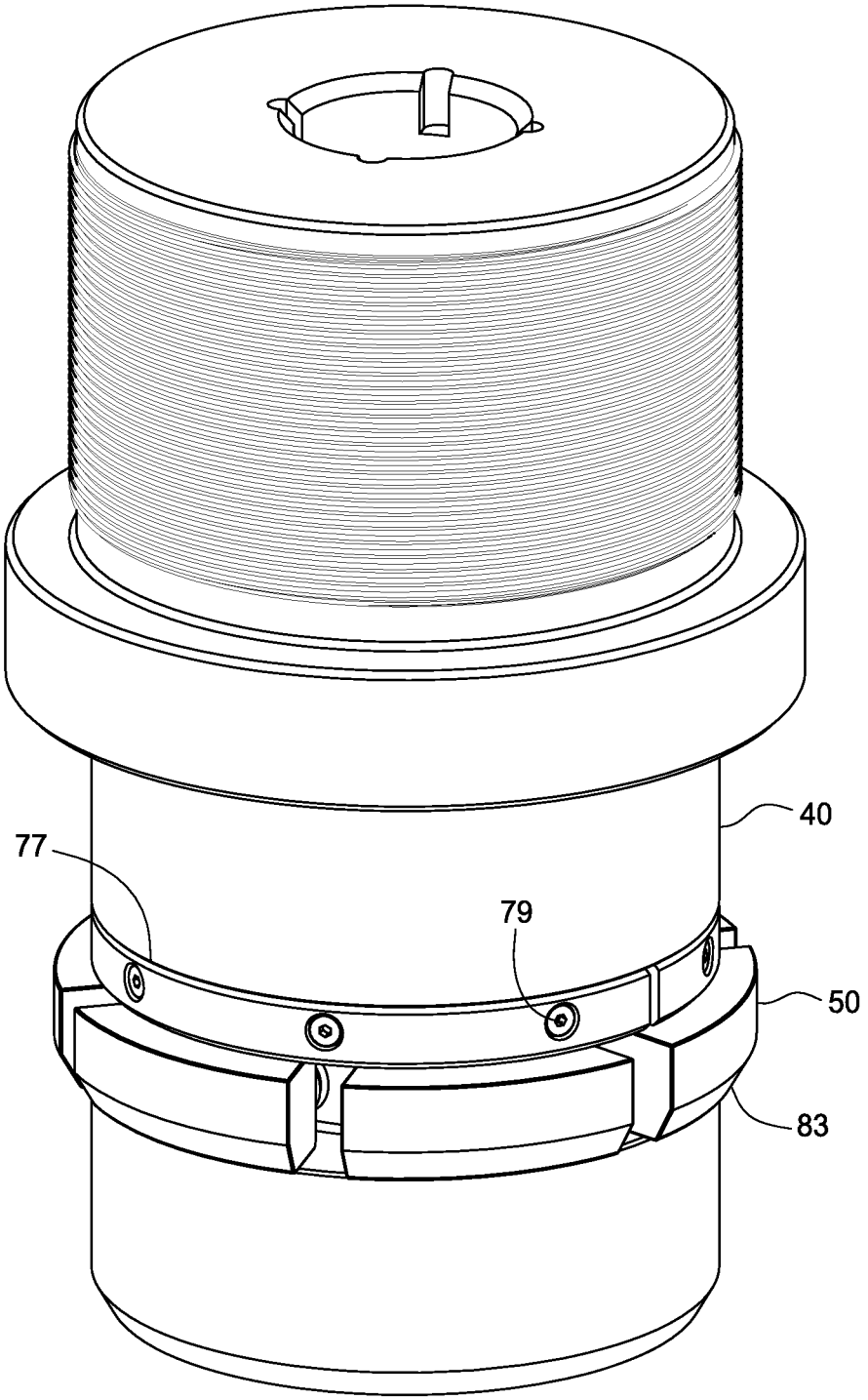
FIG. 5 is a perspective view of the locking sub of the coupling device of FIG. 1A.
Figure 6:
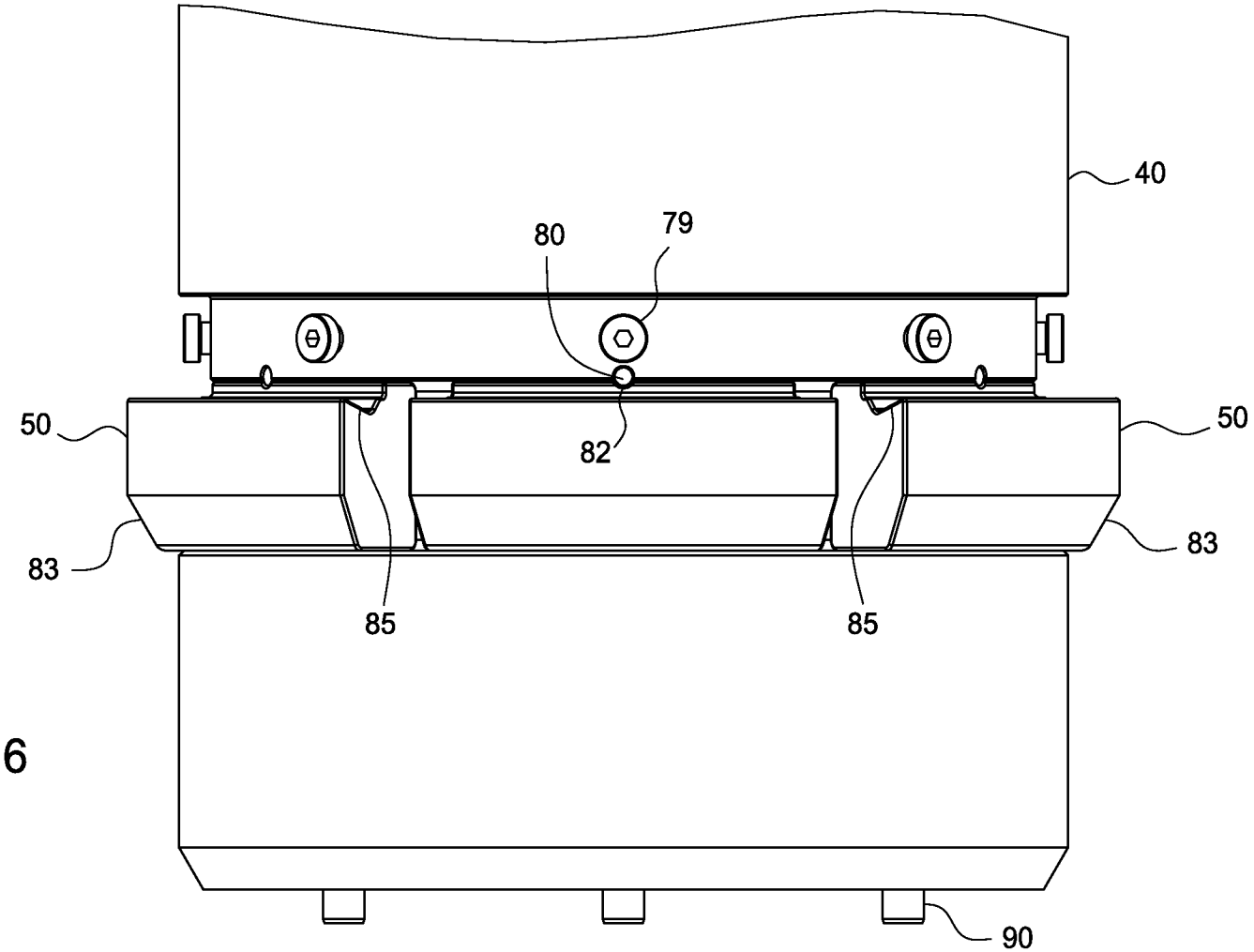
FIG. 6 is a partial enlarged view of the locking sub of FIG. 5.
Figure 7:
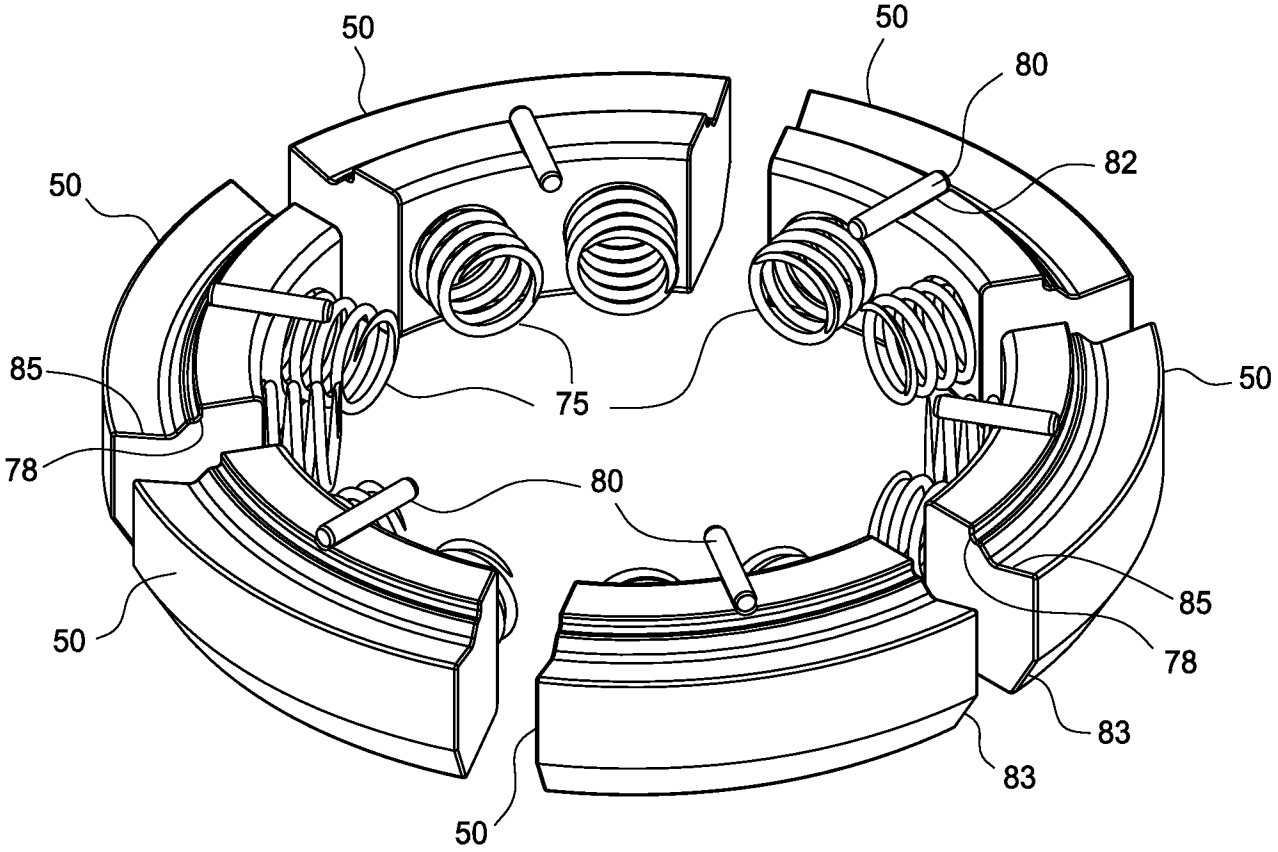
FIG. 7 is a perspective view of the locking members of the coupling device of FIG. 1A.

A locking sub 40 is attached to the interior of the conveyance adapter 30. FIG. 5 is a perspective of the locking sub 40. FIG. 6 is a partial enlarged view of the locking sub 40. FIG. 7 is a perspective view of the locking members 50. The upper end of the locking sub 40 is connected to the conveyance adapter 30 using, for example, a threaded connection. The lower end of the locking sub 40 is configured and sized for insertion into the inner diameter of component adapter 60 when the adapters 30, 60 are connected. The locking sub 40 has radially movable locking members 50 that are engageable with a locking profile such as a circumferential groove 65 formed in the inner diameter of the component adapter 60. When engaged, the locking members 50 and the circumferential groove 65 allow transmission of axial load from the drillstring 15 to the running tool 14 and the casing string 12. In one embodiment, the upper portion 67 of the component adapter 60 containing the circumferential groove 65 may be detachable from the locking sub 40. In another embodiment, the locking members 50 may be positioned in the component adapter 60 and the locking profile is formed in the conveyance adapter 30.

The locking members 50 are disposed in a recess 70 (see FIG. 9) of the locking sub 40 and circumferentially spaced apart. The locking members 50 are biased outward using a biasing member 75 such as a spring, which may be used in a plurality such as two on each locking member 50. Although six locking members 50 are shown, any suitable number of locking members 50 may be used, for example, two, three, four, or more. A suitable locking member 50 is a retractable dog. The outward movement of locking members 50 is restricted by a retainer 77. The retainer 77 overhangs the recess 70 to act as a barrier against an upper portion 78 of the locking members 50 to restrict their outward movement. The retainer 77 may be a split ring and attached to the locking sub 40 using a bolt or screw 79. Radial movement of the locking members 50 are guided by a guiding member 80. In one embodiment, the guiding member 80 is a pin. In FIG. 6, the retainer 77 is not shown to better illustrate the position of the guiding member 80. The pin 80 is positioned radially and partially engages a channel 82 on the locking member 50. The locking members 50 are movable along the pin 80. The lower portion of the locking members 50 are optionally beveled 83 to facilitate retraction of the locking members 50 when the component adapter 60 is encountered.

When the locking members 50 are radially extended, the locking members 50 are at least partially disposed inside the groove 65 of the component adapter 60. In one embodiment, the upper surface 85 of the locking member 50 is optionally angled upward for mating the upper portion 86 of the groove 65, which is angled downward (see FIG. 11). In this respect, the angled surfaces 85, 86 may assist with preventing the locking member 50 from retracting.

Figure 9:
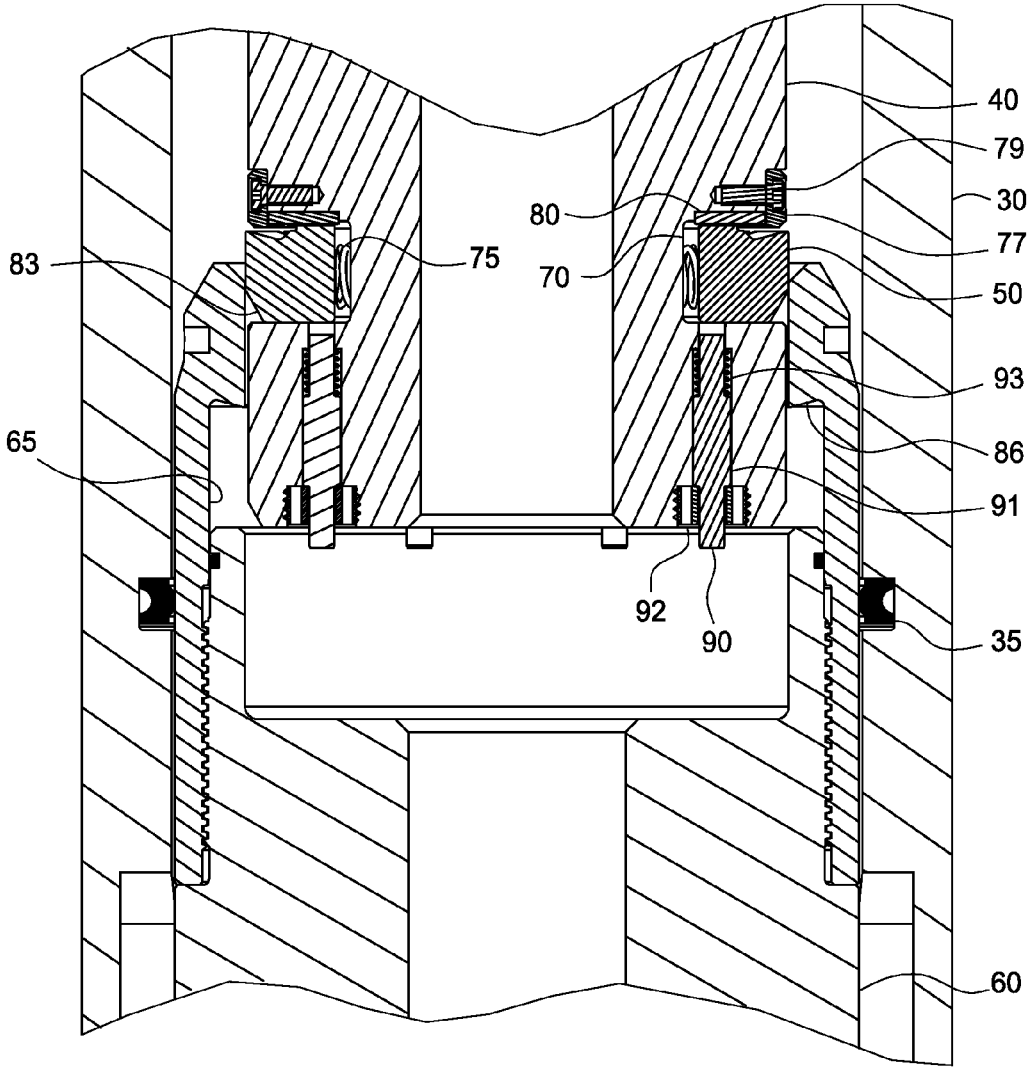
FIG. 9 is an enlarged partial view of FIG. 8.

The locking sub 40 may optionally include a retention pin 90, see enlarged view of FIG. 9. In one embodiment, the retention pin 90 is inserted in a longitudinal opening 91 from the bottom of the locking sub 40. The retention pin 90 is supported in the opening 91 using a screw 92 or a nut. The retention pin 90 is axially movable in the opening and biased in the extended position using a spring 93 or other suitable biasing member. In this position, a portion of the retention pin 90 extends below the locking sub 40. The retention pin 90 is retracted when the spring force is overcome. In this position, the retention pin 90 protrudes into the recess 70 and prevents the locking members 50 from retracting.

Figure 1B:
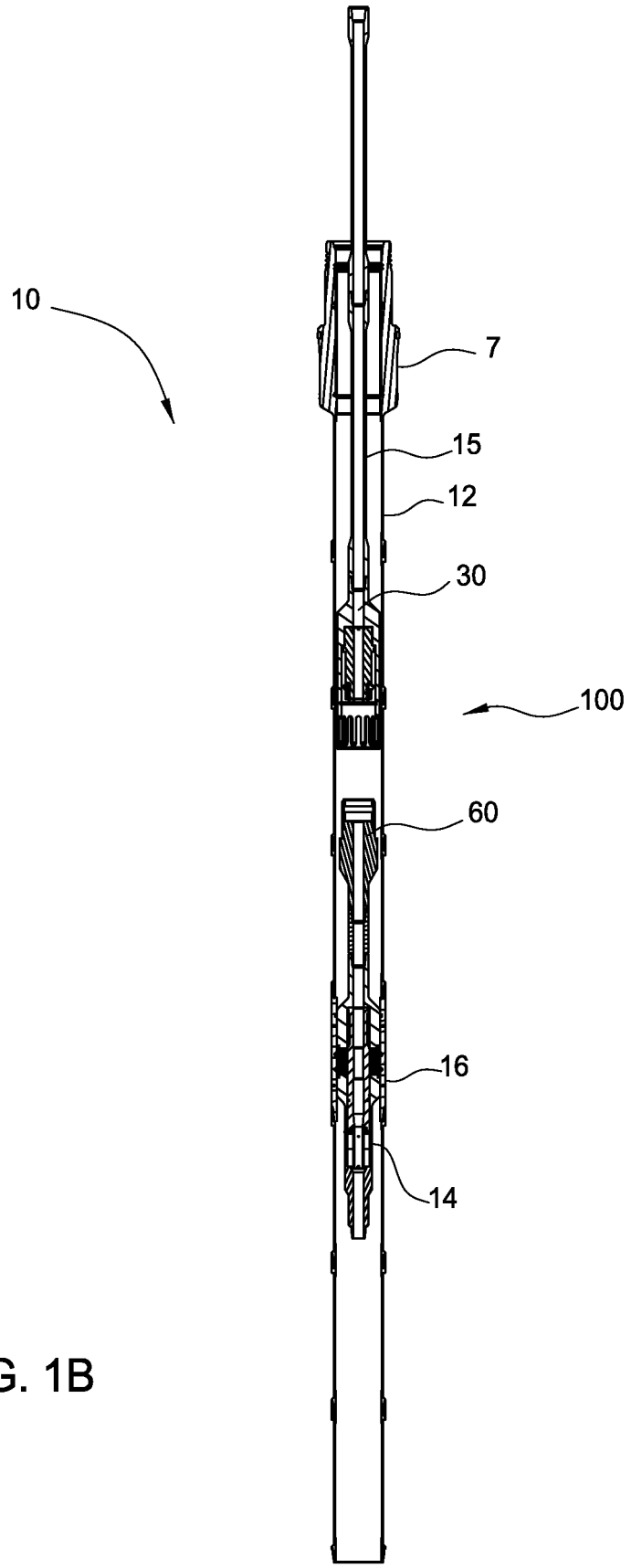
FIG. 1B shows an upper adapter of the coupling device of FIG. 1A lowered into the casing string.

In operation, the component adapter 60 (i.e., lower adapter) is preinstalled in the casing string 12 and attached to the running tool 14, as shown in FIG. 1A. The casing string 12 and the wellhead 7 may be hanging from a rig floor. The component adapter 60 may be disposed more than 300 feet below the rig floor. The conveyance adapter 30 (i.e., upper adapter) is connected to the drillstring 15 and ready to be lowered into the casing string 12 for connection with the component adapter 60. In FIG. 1B, the conveyance adapter 30 has been lowered into the casing string 12 and ready to be connected to the component adapter 60. FIG. 2 illustrates the adapters 30, 60 just before connection.

Figure 8:
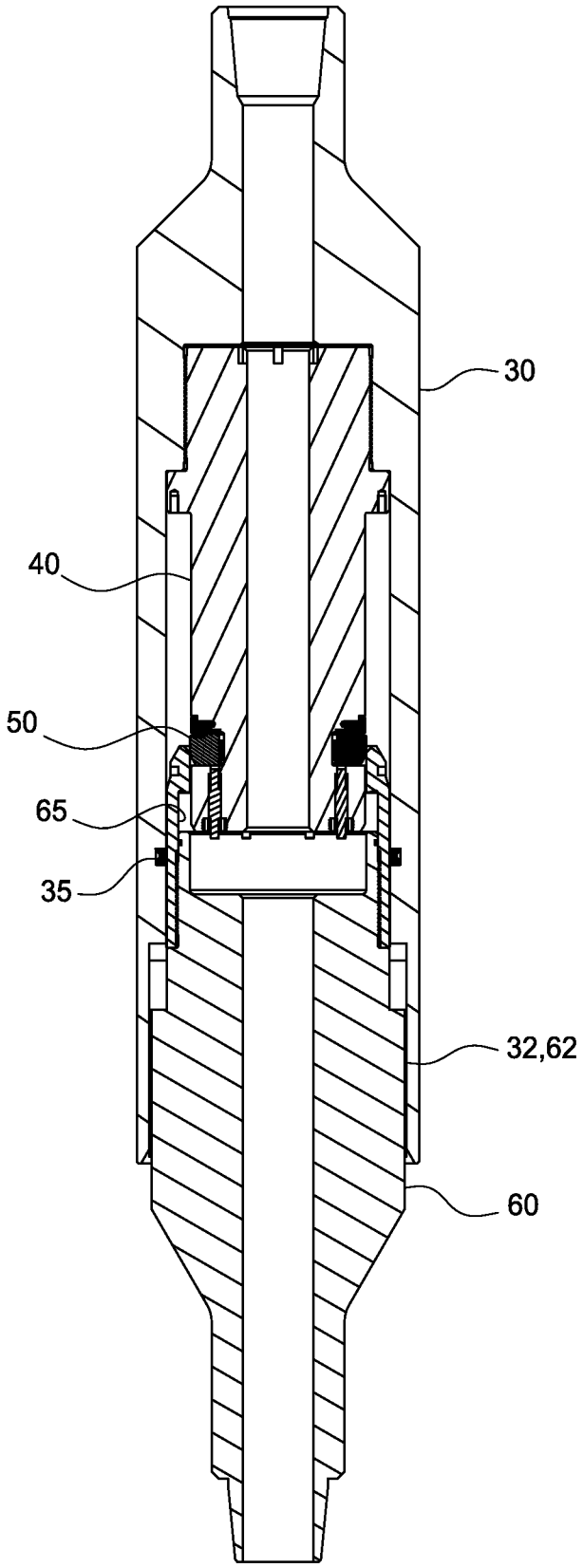
FIG. 8 illustrates the upper adapter partially engaged with the lower adapter.

FIG. 8 illustrates the conveyance adapter 30 partially engaged with the component adapter 60. In this position, the conveyance adapter 30 has slid over the outer surface of the component adapter 60. The tapered portions 33, 63 of the splines 32, 62 help align the adapters 30, 60 as they come into contact. Optionally, centralizers may be disposed around the conveyance adapter 30 or the drillstring 15 to facilitate alignment of the adapters 30, 60. As shown, the splines 32, 62 are partially engaged, and the seal 35 has engaged the outer surface of the component adapter 60. Also, the locking sub 40 is partially inside the component adapter 60, and the locking members 50 have been retracted by the component adapter 60. FIG. 9 is an enlarged partial view of FIG. 8. As the locking members 50 move down past the upper portion of the component adapter 60, the beveled lower portion 83 of the locking members 50 engage the beveled upper portion of the component adapter 60. The locking members 50 are thus retracted and the springs 75 are compressed.

Figure 10:
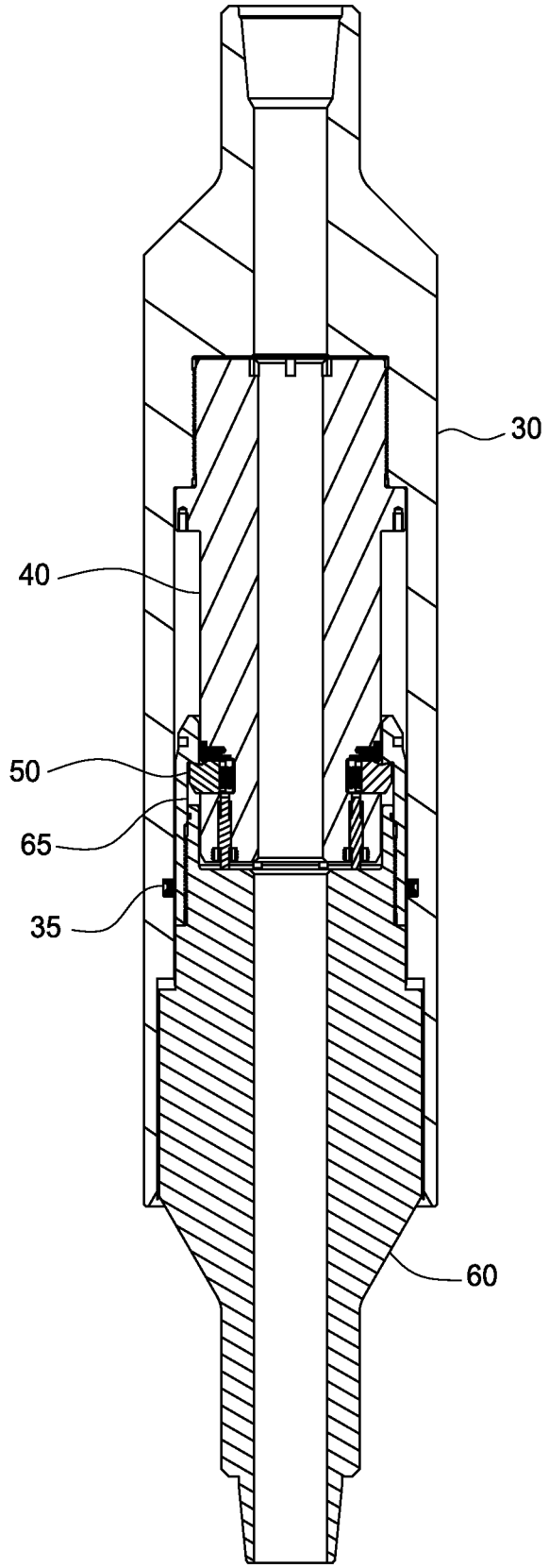
FIG. 10 shows the upper adapter and the lower adapter in the locked position.
Figure 11:
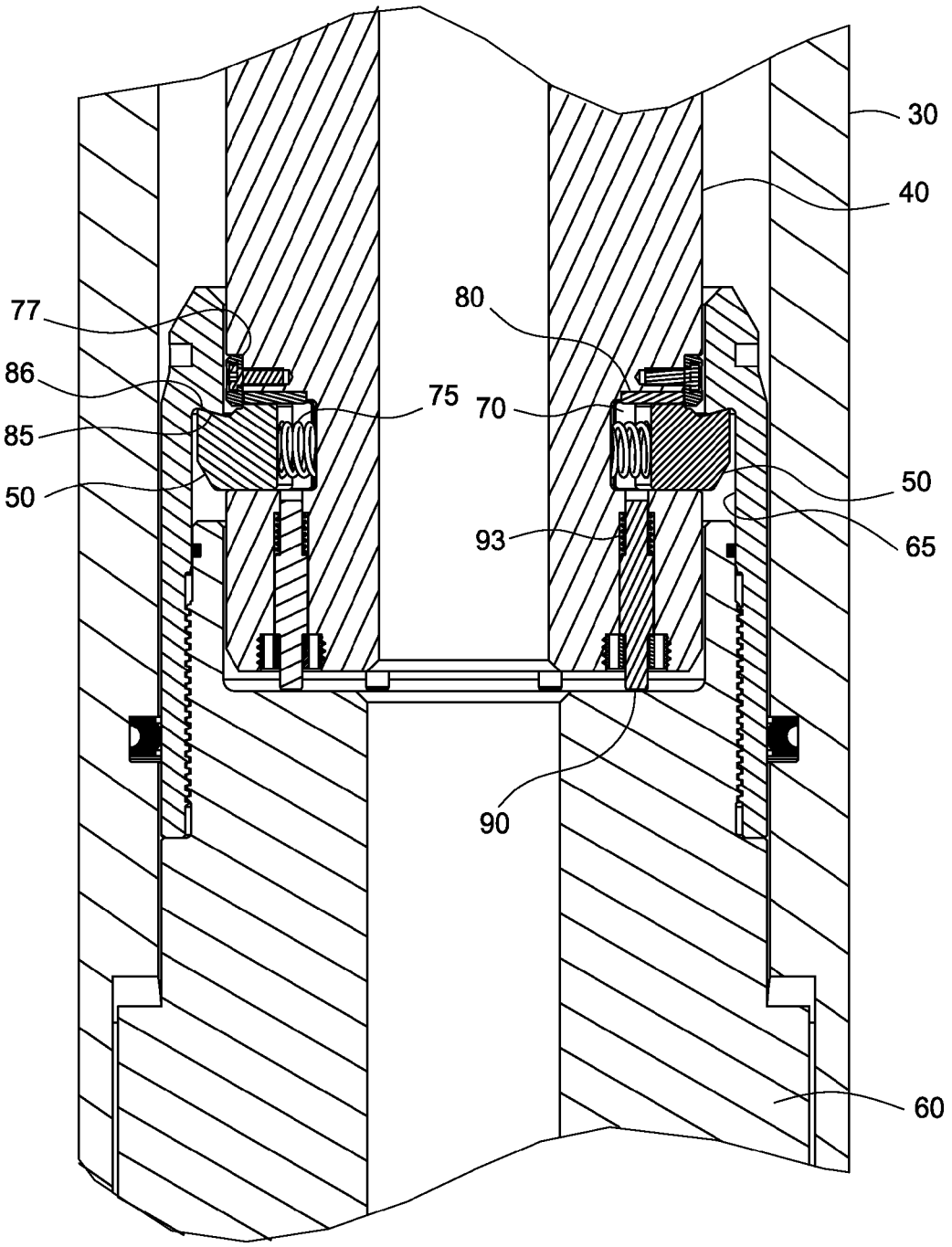
FIG. 11 is an enlarged partial view of the upper and lower adapters in the locked position.
Figure 13:
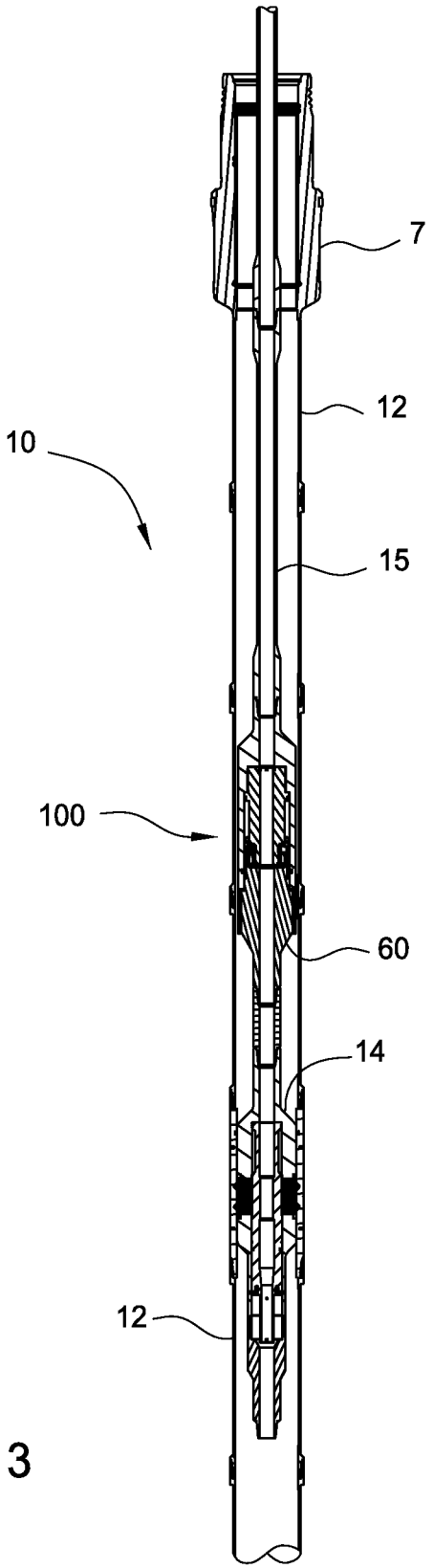
FIG. 13 shows the drillstring coupled to the casing string after engagement of the adapters.

FIG. 10 shows the conveyance adapter 30 and the component adapter 60 in the locked position. FIG. 11 is an enlarged partial view of the adapters 30, 60. The locking members 50 are located adjacent the groove 65 and biased outwardly by the spring 75. The upper portion of the locking members 50 are engaged to the lower portion of the retainer 77, thus limiting the outward movement of the locking members 50. In this manner, the drillstring 15 may be coupled to the casing string 12 by axially sliding the conveyance adapter 30 over the component adapter 60 and applying weight to actuate the locking members 50. FIG. 13 shows the drillstring 15 coupled to the casing string 12 after engagement of the adapters 30, 60. Axial and torque loads may now be transmitted to the casing string 12 from the drillstring 15. In one embodiment, the connection between the adapters 30, 60 is non-releasable downhole.

FIG. 11 further shows the adapters 30, 60 when the strings 12, 15 are placed in tension. The upper surface 85 of the locking members 50 engage with the angled surface 86 of the upper portion of the groove 65. The retention pins 90 remain biased in the extended position.

Figure 12:
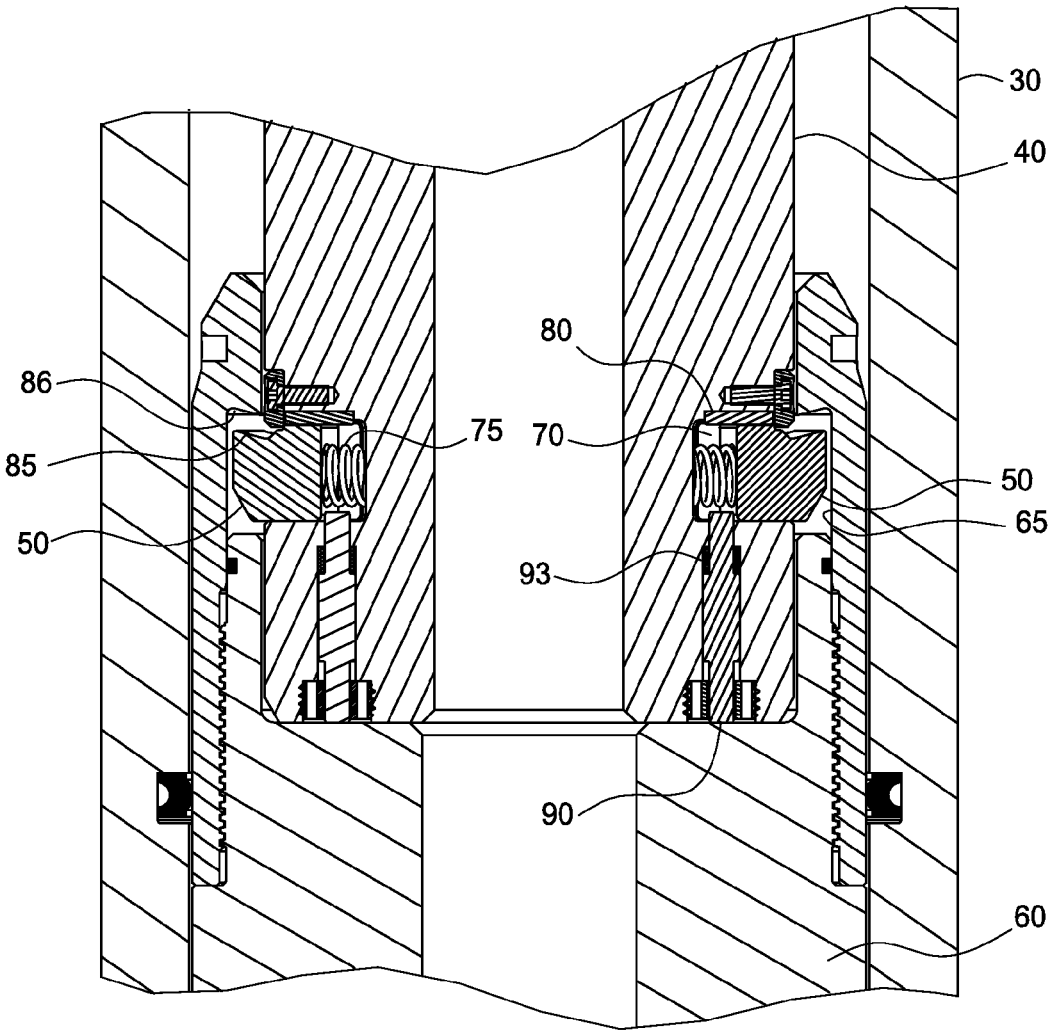
FIG. 12 shows the upper and lower adapters when the lower end of the drillstring is placed in compression

FIG. 12 shows the adapters 30, 60 when the strings 12, 15 are placed in compression, such as when weight is "set down." The conveyance adapter 30 has moved downward relative to the component adapter 60 such that the lower end of the locking sub 40 engages the component adapter 60, thereby allowing transmission of a downward force. It can be seen that the upper surface 85 of the locking members 50 has disengaged from the angled surface 86 of the upper portion of the groove 65. However, the locking members 50 remain in the extended position by the spring 75. The relative downward movement of the conveyance adapter 30 has retracted the retention pins 90 from the lower end of the locking sub 40. The retention pins 90 now protrude into the recess 70 and provide a redundant mechanism to prevent the locking members 50 from retracting.

In another embodiment, the coupling device 100 may be used to selectively connect to a first downhole tool, which in turn, may be selectively disconnected from a second downhole tool after operation. For example, the component adapter may be a pre-installed component on a first downhole tool such as a running tool. The running tool is releasably connected to a second downhole tool such as the casing using a releasable connection. To engage the running tool, the conveyance adapter is lowered into the wellbore to engage the component adapter. Thereafter, the running tool may be manipulated from surface via the conveyance member. After the operation, the running tool may be disconnected from the casing by disengaging at the releasable connection. In this respect, a downhole tool may have two different locations to connect and/or disconnect from two different downhole tools. Exemplary downhole tools include packers, motors, pumps, sensors, sliding sleeves, hydraulically or mechanically set liner hangers, whipstocks, valves, cement shoe assemblies, drill bits, and downhole tubulars such as drill pipe, casing, liners, coiled tubing, and production tubing.

Figure 14:
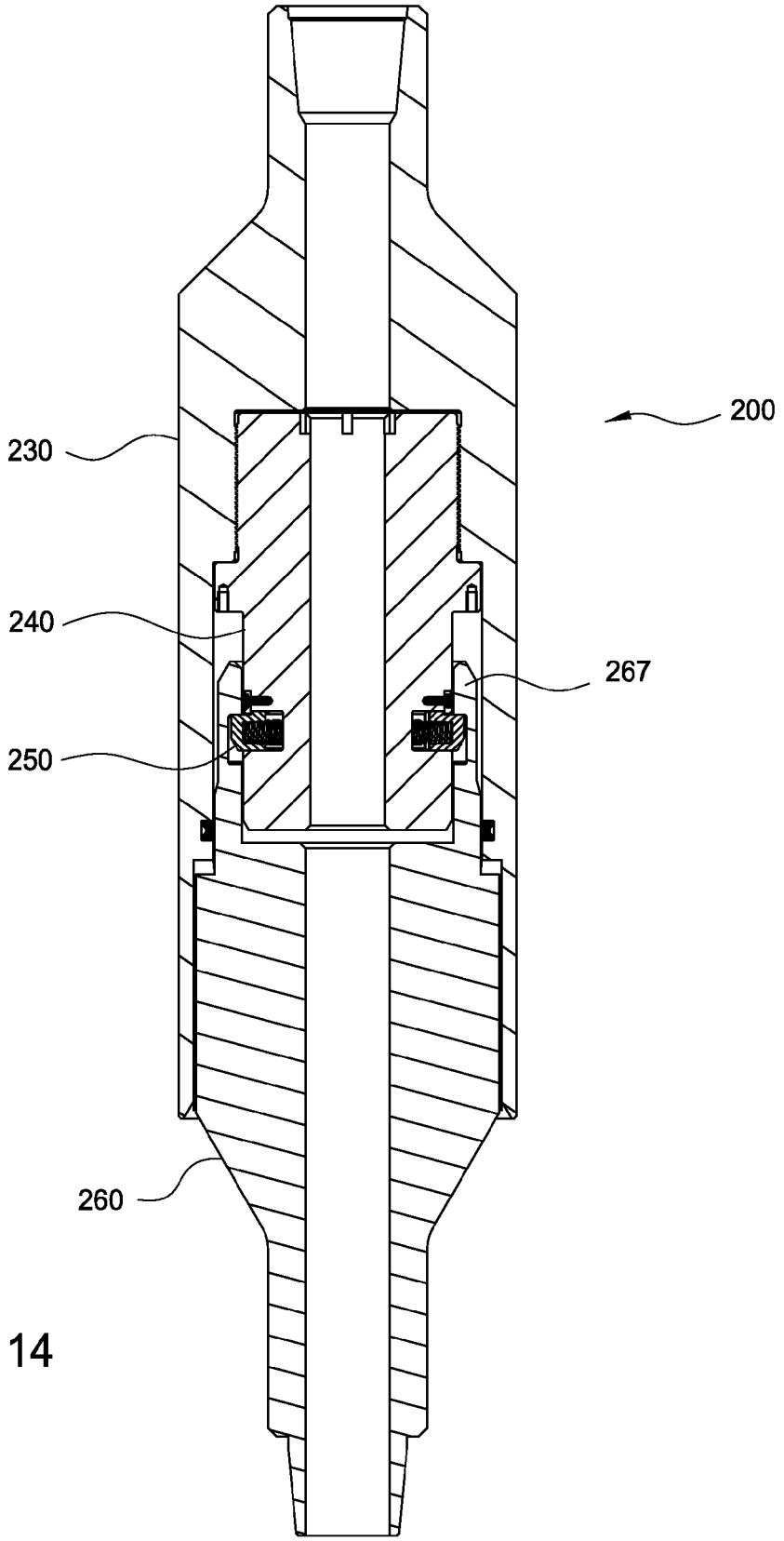
FIG. 14 illustrates another embodiment of a coupling device.

FIG. 14 illustrates another embodiment of a coupling device 200. The coupling device 200 is substantially similar to the coupling device 100 shown in FIG. 2. The coupling device 200 has a conveyance adapter 230 connected to a component adapter 260 using splines or other suitable torque transfer mechanisms. The coupling device 200 also includes a locking sub 240 having locking members 250 for engagement with the component adapter 260. However, the coupling device 200 is shown without the optional retention pin 90. Also, the upper portion 267 of the component adapter 260 is shown as an integral portion of the component adapter 260. In the example shown in FIG. 14, the upper portion includes the groove for receiving the locking members 250.

Figure 15:
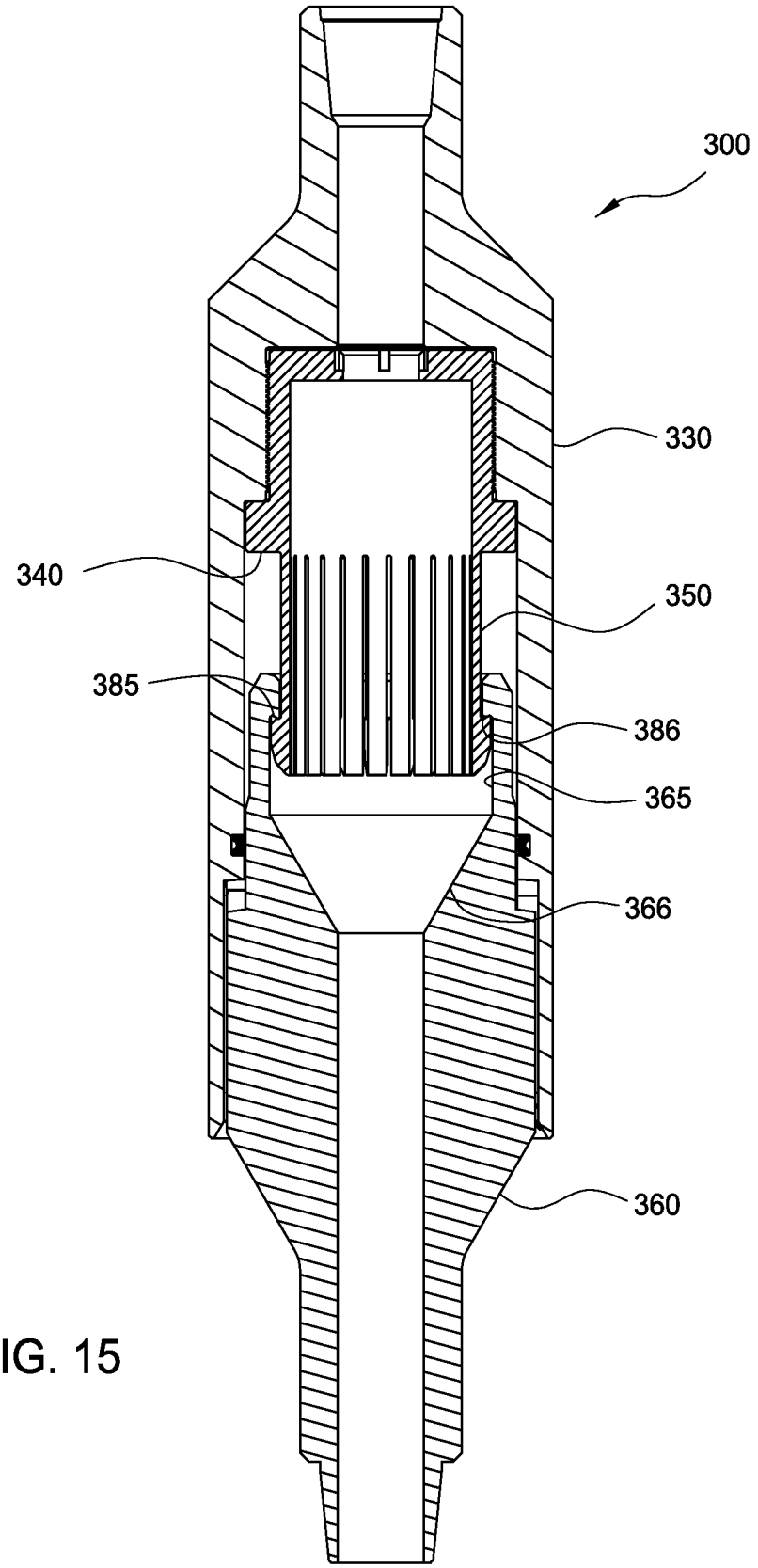
FIG. 15 illustrates another embodiment of a coupling device.
Figure 16:
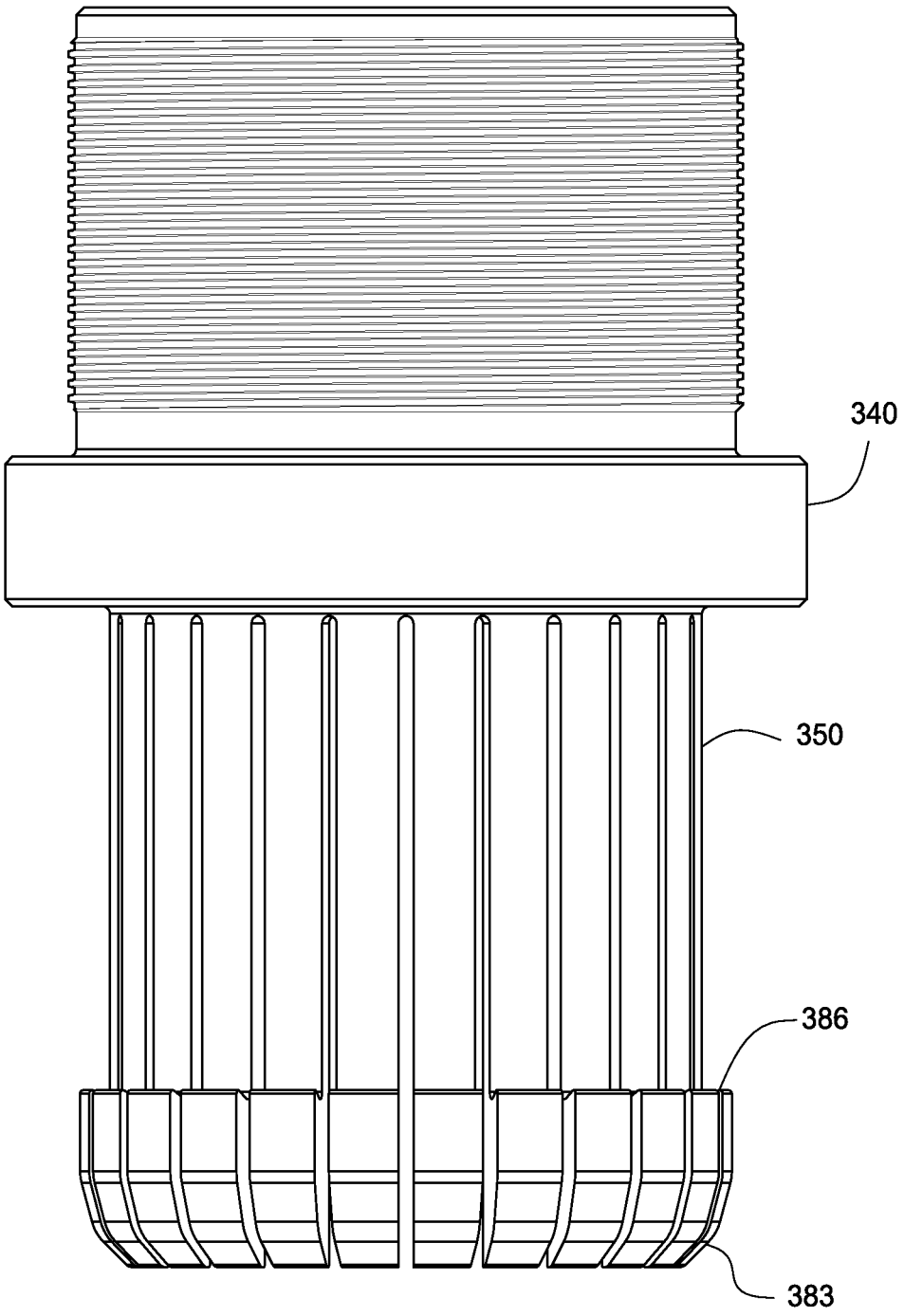
FIG. 16 shows an enlarged view of the locking sub of the coupling device of FIG. 15.

FIG. 15 illustrates another embodiment of a coupling device 300. The coupling device 300 is substantially similar to the coupling device 100 shown in FIG. 2. The coupling device 300 has a conveyance adapter 330 connected to a component adapter 360 using splines or other suitable torque transfer mechanisms. The coupling device 300 also includes a locking sub 340 having locking members 350 for engagement with the component adapter 360. In this embodiment, the locking members are in the form of a collet. FIG. 16 shows an enlarged view of the locking sub 340. The collet fingers 350 have an outward shoulder 386 formed at the distal end. The outward shoulders 386 are configured to engage with a locking profile on the interior of the component adapter 360. As shown, the locking profile is an inward shoulder 385. The lower end of the collet may be beveled 383 to facilitate inward movement of the collet fingers 350. When the collet fingers 350 move past the component adapter 360, the collet fingers 350 are flexed inwardly. When the outward shoulders 386 are adjacent the groove 365, the collet fingers 350 flex back to allow the outer shoulders 386 to engage the inward shoulders 385. The inner diameter of the component adapter 360 may have a cone shaped portion 366 below the shoulders 385, 386. The cone shaped portion 366 may assist with the retraction of the collets 350 for separating the adapters 330, 360. It must be noted the coupling device 300 is shown without the optional retention pin 90. Also, the upper portion of the component adapter 360 containing the shoulders 385 is shown optionally as an integral portion of the component adapter 360.

Figure 18A:
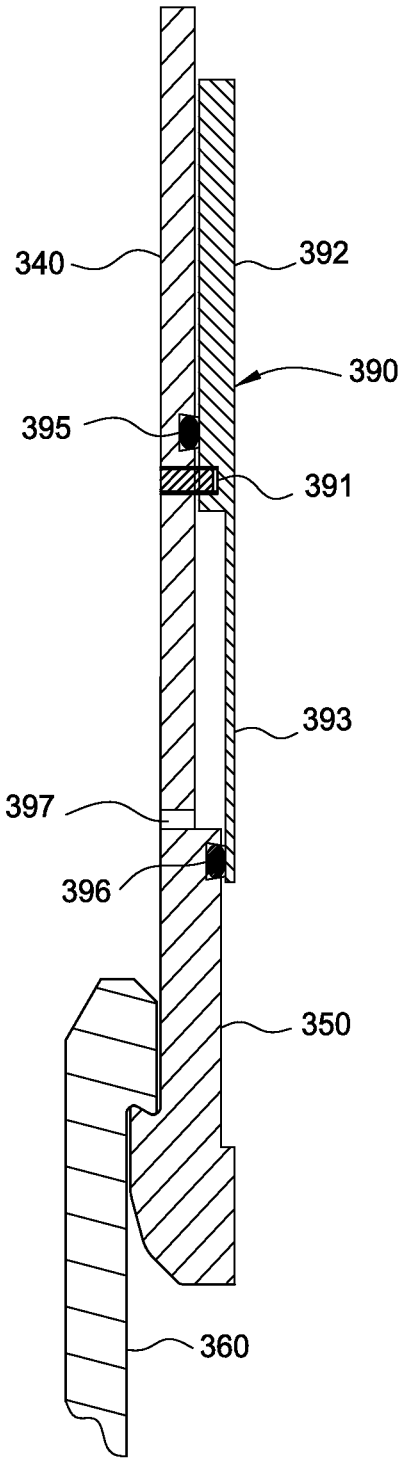
FIGS. 18A-B illustrate another embodiment of the coupling device of FIG. 15.
Figure 18B:
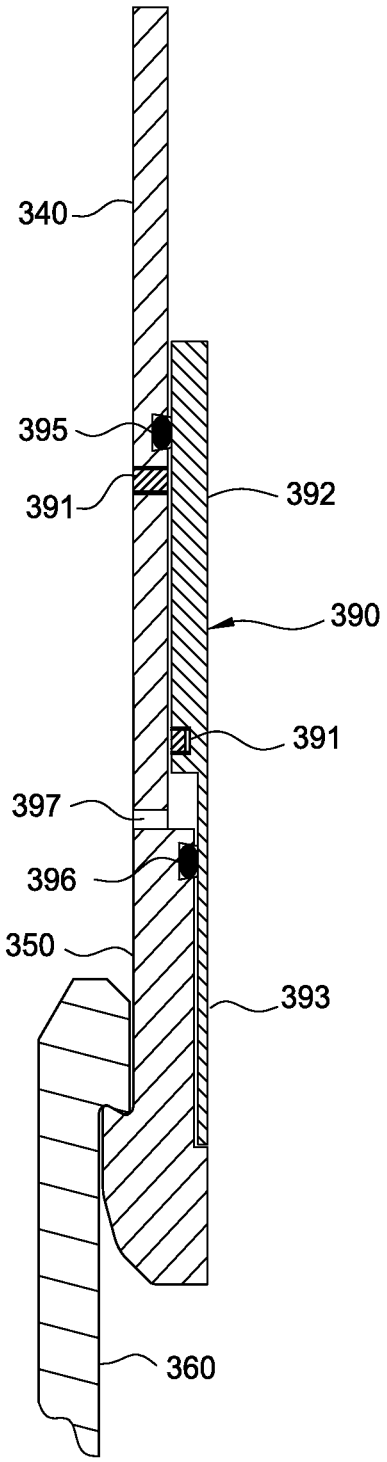

In another embodiment, as shown in FIGS. 18A-B, the coupling device 300 may include an optional retention sleeve 390 disposed in the locking sub 340 to prevent the collet fingers 350 from retracting. As shown in FIG. 18A, the retention sleeve 390 may initially be positioned in an upper, interior portion of the locking sub 340 where the retention sleeve 390 does not inhibit retraction of the collet fingers 350. The retention sleeve 390 may be held in position using a shearable member 391 such as a pin. An outer diameter of an upper portion 392 of the retention sleeve 390 is larger than an outer diameter of a lower portion 393. Seals 395, 396 may be disposed between the retention sleeve 390 and the locking sub 340 at the upper and lower portions 392, 393. The space (e.g., "slits") between the collet fingers allow venting between the locking sub 340 and the retention sleeve 390. In another embodiment, an optional port 397 may be formed in the locking sub 340 between the upper and lower seals 395, 396 to allow venting between the locking sub 340 and the retention sleeve 390. After the collet fingers 350 have engaged the component adapter 360, fluid pressure inside the locking sub 340 is increased to break the shearable member 391. The increased pressure will generate a larger force at the upper portion 392 than the lower portion 393 of the retention sleeve 390, thereby creating a net downward force to break the shearable member 391. After release, the retention sleeve 390 moves downward to a position adjacent the collet fingers 350, thereby preventing the collet fingers 350 from retracting, as shown in FIG. 18B.

Figure 17:
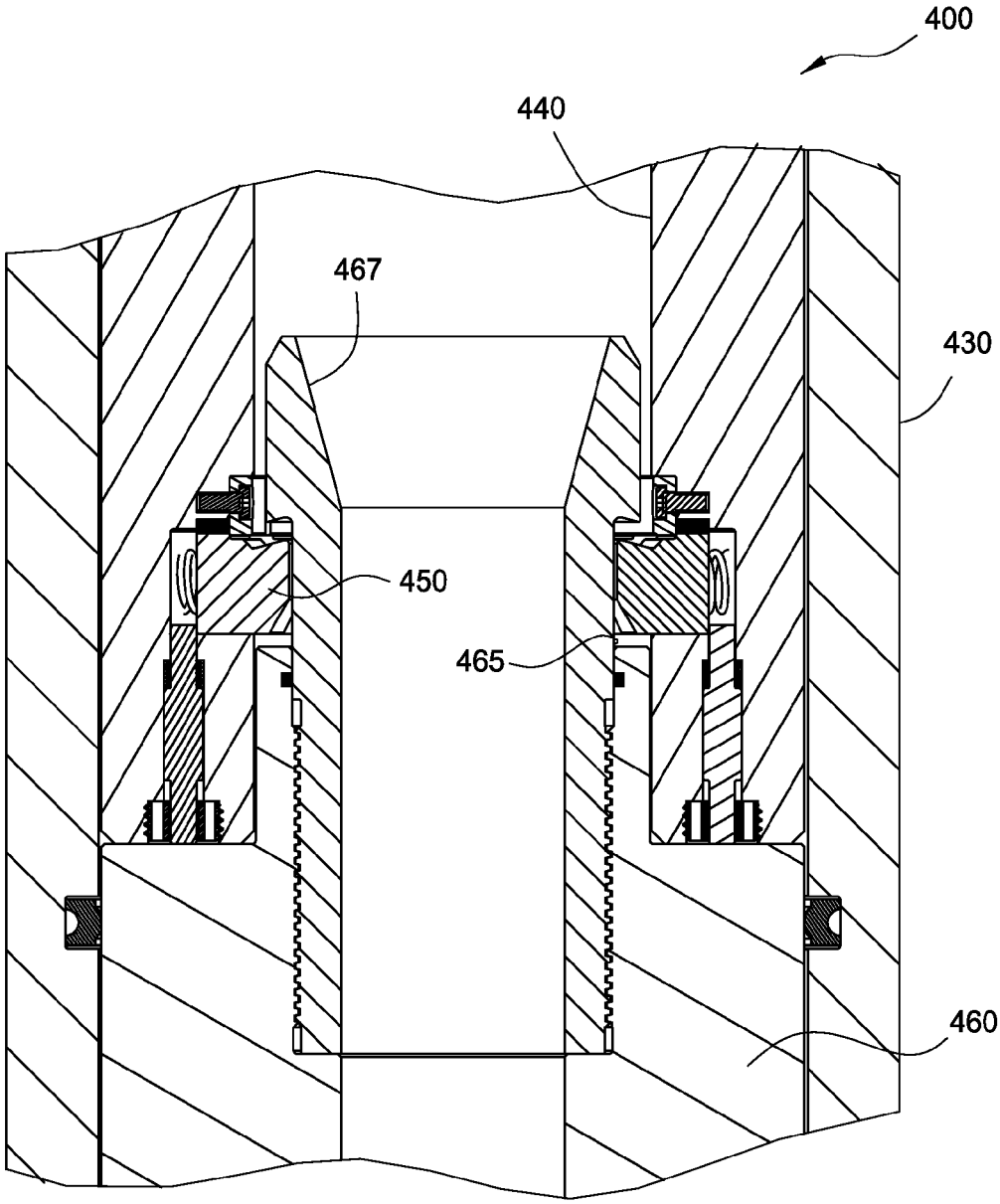
FIG. 17 illustrates another embodiment of a coupling device.

For embodiments described herein, it is contemplated that the locking members and torque transfer members such as the splines may be placed at different locations on the conveyance adapter and the component adapter so long as the coupling device is capable of transferring axial and torque load. For example, FIG. 17 shows another embodiment of a coupling device 400. The conveyance adapter 430 engages the component adapter 460 by sliding over the outer surface of the component adapter 460 similar to the coupling device 100 of FIG. 2. However, the locking sub 440 is arranged to locate on the outside of the upper portion 467 of the component adapter 460. Additionally, the locking members 450 face radially inward, and the groove 465 faces outward to receive the locking members 450.

In yet another embodiment, a downhole tool includes a running tool releasably connected to the downhole tool; a first adapter connected to the running tool; a second adapter connected to a running string, configured to mate with the first adapter, wherein when the first and second adapters are mated together, the connection so formed is not releasable downhole.

In one or more of the embodiments described herein, the connection is capable of transmitting an axial load.

In one or more of the embodiments described herein, the connection is capable of transmitting a torque load.

In yet another embodiment, a method of operating a downhole tool includes releasably connecting a running tool to the downhole tool; connecting a first adapter to the running tool; connecting a second adapter to a running string; mating the first adapter to the second adapter, wherein the connection so formed is not releasable downhole; and transmitting at least one of an axial load and a torque load from the running string to the running tool. The method may further include releasing the running tool from the downhole tool while downhole. The downhole tools may be any as listed herein. The downhole tool may be operated by the transmission of at least one of torque, axial load, fluid flow, fluid pressure, and combinations thereof from the running string. The operation of the downhole tool may include at least one of drilling, milling, and combinations thereof.

In yet another embodiment, a downhole tool assembly includes a first downhole tool; a releasable connection to a second downhole tool; a component adapter; a conveyance adapter connected to a conveying member; and a locking mechanism for connecting the component adapter to the conveyance adapter, wherein the locking mechanism is actuated by axial movement of the conveyance adapter relative to the component adapter, and wherein the connection between the adapters is configured to transmit axial and torque loads from the conveying member to the first downhole tool.

In one or more of the embodiments described herein, the adapters are non-releasable downhole.

In one or more of the embodiments described herein, the locking mechanism prevents release of the first and second adapters downhole.

While the foregoing is directed to embodiments of the invention, other and further embodiments of the invention may be devised without departing from the basic scope thereof, and the scope thereof is determined by the claims that follow.

The invention claimed is:

1. A coupling device for coupling a conveying member to a downhole tool, comprising:

a first adapter connected to the conveying member;

a second adapter connected to the downhole tool; and a locking mechanism for connecting the first adapter to the second adapter to form a connection downhole, wherein the locking mechanism includes a locking member connected to an interior surface of the first adapter and a locking profile located in an interior facing surface of the second adapter, wherein the second adapter is configured for insertion into the first adapter for engaging the locking member to the locking profile, and wherein the coupling device is configured to transmit axial and torque loads from the conveying member to the downhole tool after the first adapter connects to the second adapter.

2. The coupling device of claim 1, wherein the locking member comprises a retractable dog and the locking profile comprises a groove.

3. The coupling device of claim 1, wherein the locking member comprises a collet and the locking profile comprises a shoulder.

4. The coupling device of claim 1, wherein the locking mechanism further comprises a locking sub for connecting the locking member to the interior surface of the first adapter.

5. The coupling device of claim 1, wherein the locking member is radially movable.

6. The coupling device of claim 5, further comprising a biasing member for moving the locking member.

7. The coupling device of claim 5, further comprising a guiding member for guiding movement of the locking member.

8. The coupling device of claim 5, further comprising a retention member for preventing retraction of the locking member.

9. The coupling device of claim 5, further comprising a retainer for limiting movement of the locking member.

10. The coupling device of claim 1, wherein the torque load is transmitted using a spline connection between the first adapter and the second adapter.

11. A method of connecting a first tool to a second tool in a wellbore, comprising:

attaching a first adapter to the first tool, wherein the first adapter includes a locking member disposed in a bore of the first adapter;

attaching a second adapter to the second tool, wherein the second adapter includes a locking profile located on an interior facing surface of the second adapter for receiving the locking member the locking member;

positioning the second adapter and the second tool in the wellbore;

lowering the first adapter and the first tool;

inserting the second adapter located in the wellbore into the first adapter and engaging the locking member to the locking profile by axially moving the first adapter relative to the second adapter, and transmitting axial and torque loads from the first tool to the second tool.

12. The method of claim 11, further comprising providing mating surfaces on the locking member and the locking profile; and engaging the mating surfaces of the locking member to the mating surfaces of the locking profile when the first adapter and the second adapter are placed in tension.

13. The method of claim 11, further comprising providing a retention pin for preventing retraction of the locking member when the first adapter and the second adapter are placed in compression.

14. The method of claim 11, wherein the locking profile is located in an interior surface of the second adapter.

15. The method of claim 11, wherein the second adapter is inserted between the locking member and the first adapter.

16. A method of manipulating a downhole tool in a wellbore using a conveying member, comprising:

attaching a first adapter to the conveying member, wherein the first adapter includes a locking member;

attaching a second adapter to the downhole tool, wherein an inner facing surface of the second adapter includes a locking profile for receiving the locking member;

lowering the first adapter and the conveying member into the wellbore;

inserting the second adapter located in the wellbore into the first adapter and engaging the locking member to the locking profile by axially moving the first adapter relative to the second adapter, rotating the downhole tool by transmitting torque from the conveying member; and axially moving the downhole tool by transmitting axial loads from the conveying member.

17. The method of claim 16, further comprising selectively releasing the downhole tool from another downhole tool.

18. The method of claim 16, wherein the second adapter is inserted between the locking member and the first adapter.

19. The method of claim 18, wherein the locking member is connected to the first adapter using a locking sub.

20. A downhole tool assembly, comprising:

a running tool releasably connected to a downhole tool;

a first adapter threadedly connected to the running tool;

a second adapter connected to a running string;

a locking mechanism for connecting the first adapter to the second adapter to form a connection downhole, wherein the locking mechanism includes a locking member connected to an interior surface of the first adapter and a locking profile located in an interior facing surface of the second adapter, wherein the second adapter is configured for insertion into the first adapter for engaging the locking member to the locking profile, and wherein when the first and second adapters are connected together, the connection so formed is not releasable downhole, and wherein the connection is configured to transmit axial and torque loads.

21. The assembly of claim 20, wherein the running tool includes a movable engagement member for connecting to the downhole tool.

22. The assembly of claim 20, further comprising a locking sub for connecting the locking member to the interior surface of the first adapter and wherein the second adapter is disposed between the locking sub and the first adapter.

23. A method of operating a downhole tool in a wellbore, comprising:

actuating an engagement member of a running tool into engagement with the downhole tool;

connecting a first adapter to the running tool;

connecting a second adapter to a running string, wherein the second adapter includes a locking member for engaging a locking profile of the first adapter;

inserting the first adapter between the locking member and the second adapter and engaging the locking member to the locking profile;

transmitting at least one of a downward axial load, a torque load, fluid flow, fluid pressure, and combinations thereof, from the running string to the running tool; and releasing the running tool from the downhole tool in the wellbore.

* * * * *